United States Patent [19]

Morrison

[11] Patent Number: 4,657,431

[45] Date of Patent: Apr. 14, 1987

[54] NON-UNIFORM SIZE PARTICULATE SPREADER

[76] Inventor: Donald R. Morrison, 6228 Eagle Peak Dr., Charlotte, N.C. 28214

[21] Appl. No.: 841,239

[22] Filed: Mar. 19, 1986

[51] Int. Cl.[4] ..... E01C 19/06

[52] U.S. Cl. ..... 404/108; 404/110; 222/626; 222/238; 222/414

[58] Field of Search ..... 404/110, 108, 106; 222/626, 623, 624, 625, 138, 410, 414, 311

[56] References Cited

U.S. PATENT DOCUMENTS 3,048,304 8/1962 Polzin ..... 222/238 X
3,228,310 1/1966 Cartwright ..... 404/110
3,670,671 6/1972 Lienemann et al. ..... 222/623 X
4,607,979 8/1986 Morrison ..... 404/110

*Primary Examiner*—Carl D. Friedman
*Attorney, Agent, or Firm*—B. B. Olive

[57] ABSTRACT

A material spreader for handling both rock and powder-like materials incorporates a hopper assembly with a hydraulically motor driven side discharge as compared to the conventional bottom discharge. The hopper assembly in one embodiment is supported directly above the surface being covered by hydraulically motor driven wheeled frames and in another embodiment is supported by a carriage on a bridge spanning the work surface. A gasoline engine driven hydraulic system mounts on and moves with the hopper assembly during spreading and includes a mechanism for automatically reversing the direction of travel.

10 Claims, 8 Drawing Figures

NON-UNIFORM SIZE PARTICULATE SPREADER

CROSS REFERENCE TO RELATED APPLICATION

The present invention relates to applicant's co-pending application Ser. No. 685,244, filed Dec. 21, 1984, entitled "Hydraulically-Powered Material Spreader" now U.S. Pat. No. 4,607,979.

TECHNICAL FIELD

The present invention relates to material spreaders of the type having a hopper which is supported above and which moves above a surface and deposits a layer of material over the surface.

BACKGROUND ART

The prior art includes a variety of types of material spreaders. Conventional lawn fertilizer spreaders include a hopper and a finger agitator rotated by spreader wheels. More closely related to the invention apparatus are material spreaders adapted for heavy duty use in conjunction with the spreading of rock or other relatively hard and relatively large size particulate material during construction. A number of companies make material spreaders for evenly spreading a layer of topping material on the wet surface of spans of concrete. One such type conventional spreader mounts one or more hoppers on a bridge which spans the width of the concrete. The hoppers are driven back and forth on the bridge to spread the material. The bridge is mounted on wheels and is manually moved lengthwise of the span after each single, double or other number of passes of the hoppers depending on the depth of material being spread. The hopper drive mechanism for a spreader of this type is typically powered either electrically or pneumatically which requires either power cables or air lines to be fed back and forth across the concrete span being worked. Such arrangements inherently require additional support structure and expense for the added structure, cables and air lines.

In applicant's prior U.S. Pat. No. 4,555,200, entitled "Hydraulically Powered Material Spreader", the prior art is referred to and there is described a substantially improved material spreader in which the hoppers and spreader box are mounted on a support structure which is driven back and forth along an elevated path by means of gasoline engine powered hydraulic apparatus mounted on the same support structure. Heat, which accumulates in the hydraulic fluid during operation of the spreader, is dissipated by means of an improved reservoir/hopper-cooling arrangement which allows the heat to be absorbed both by a hopper wall and by the material being spread.

Experience with the type hydraulically-driven spreader described in U.S. Pat. No. 4,555,200 has proven that such spreader is well suited to spreading relatively uniform and relatively small size particles such as sand. However, the spreader taught in such patent as well as all other spreaders known to applicant failed to provide a spreader uniquely adapted for spreading large size rock and particularly with a hydraulic drive. A demand for spreading relatively large and non-uniform size rock, for example of ½" to 2" screen size, has arisen because of the trend towards using exposed aggregate in buildings and also because of the trend in forming patios, sidewalks, and floors with relatively large aesthetically attractive and long-wearing rock surfaces.

The object of the invention described in applicant's copending application, Ser. No. 685,244, was that of providing a spreader more specifically adapted and useful in spreading relatively large and relatively non-uniform rock. The spreader of the copending application employs a pair of spring-loaded gates on opposite sides of a metal, hydraulically, motor-powered, rough-surfaced cylinder which rotates in a selected direction coordinated with the direction of travel of the hoppers on the bridge and which on each pass forces the rock out of the hoppers between one of the gates and the cylinder. The gates pivot back and forth according to the size rock passing through between the gate and the cylinder thus automatically accommodating both to the size rock being spread and to rock jams during which the hydraulic drive stalls without damage until cleared.

A relatively recent trend in the industry has been the practice of making concrete floors more light reflective by spreading light reflective, floor hardening material on wet concrete and allowing such material to become part of the finish surface both to harden the surface and reduce the electrical power lighting load. Such material is normally in a powder-like form. One such light reflective, floor hardener, powder-like, silica based, material is available by way of example from the Euclid Chemical Co., 19218 Redwood Road, Cleveland, Oh. 44110. Therefore, the same industrial job may require spreading, for example, one-half inch trap rock for one purpose as well as spreading the powder-like light reflecting and floor hardening material in other areas of the same job. Conventional spreaders have not readily adapted to this wide range of particulate size.

In another aspect of using prior art material spreaders on industrial jobs is the fact that as the use of such spreaders has increased, the quantity of material spread and thus the amount of power required to dispense the material from the hoppers has become a major consideration. The present invention recognizes that in prior art spreaders where the dispensing cylinder with vanes is located directly below the hopper load of material the vanes are necessarily lifting material during part of the cylinder rotation. This mode of operation consumes substantial power. Additionally, for many industrial and other job requirements it has become necessary to substantially improve the smoothness of the surface of spread material to eliminate or at least substantially reduce the so-called "washboard effect" in spread material inherent to prior art spreaders.

With the foregoing in mind, the object of the present invention is that of providing a spreader adapted to handle a wide range of particulate material ranging, for example, from relatively large size rock to powder-like material, a spreader inherently able to spread the material so as to achieve a smoother surface than has been achieved with prior art spreaders to eliminate or at least substantially reduce the so-called washboard effect, a spreader which in operation requires substantially less power to dispense the material than has been required with prior art spreaders and finally a spreader adapted for use either on a conventional bridge spanning the area to be covered or without a bridge where a single hopper spans the area to be covered as, for example, in spreading rock for highway application. The foregoing and other objects will become apparent as the description proceeds.

DISCLOSURE OF INVENTION

The present invention provides a spreader especially useful for spreading a wide range from relatively large to relatively small size materials as well as relatively non uniform size rock, gravel, stone, pebbles, light reflective and floor hardening powder, and the like. All such materials are herein referred to for convenience as particulate material. In a first embodiment, a bridge is supported above and spans the width of the area being covered and is fitted with wheels for movement of the spreader lengthwise of the area being covered. A pair of oppositely-disposed hoppers are movably supported on the bridge and store a supply of the particulate material. The particulate material is dispensed from the hoppers through a spreader box which joins each of the hoppers and lays down a single, wide, uniform and substantially smooth surfaced width of material on each pass. The hoppers and spreader box are mounted on a support structure which is driven back and forth along an elevated path by means of gasoline engine powered hydraulic apparatus also mounted on the same support structure. Heat, which accumulates in the hydraulic fluid during operation of the spreader, is dissipated by means of a reservoir/hopper cooling arrangement which allows the heat to be absorbed both by a hopper wall and by the rock particulate material being spread.

Of particular significance to the present invention is the use of a hydraulically motor-driven dispensing cylinder fitted with dispensing vanes mounted in a dispensing pan near an outlet for side discharge rather than vertical discharge of the material. The cylinder always rotates in the same direction irrespective of the direction of the pass rather than changing direction of rotation depending on the direction of the pass as in the prior art. An adjustable gate regulates the volume of material spread. The lengthwise extending, horizontal axis of the dispensing cylinder is offset from the central, vertical lengthwise extending plane of the hopper such that the weight of the downwardly moving material is directed principally against the pan rather than against the dispensing cylinder prior to discharge thus avoiding the need for the vanes to lift non-discharged material as in the prior art thereby substantially reducing the power required to operate the dispensing cylinder.

In a second embodiment, a single hopper structure is wheel mounted and extends across and moves in the direction of the area to be covered, as for example in association with spreading rock for highway construction. The described side discharge apparatus is modified so as to discharge from a single rather than from a pair of hoppers.

BEST MODE FOR CARRYING OUT THE INVENTION

Figure 1:
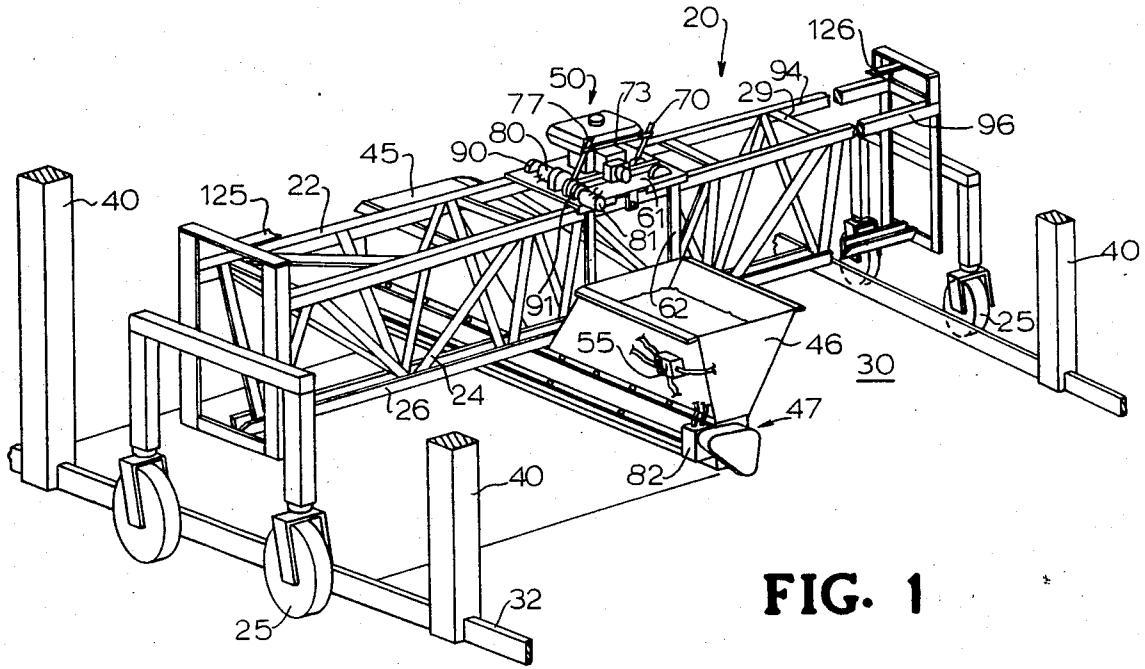
FIG. 1 is a pictorial view of the invention apparatus according to a first embodiment.

Referring initially to FIG. 1 and a first embodiment of the invention, there is illustrated the spreader 20 of the invention fitted with a bridge 22 and sets of wheels 25 on each end of the bridge 22, for moving bridge 22 lengthwise of a rectangular-shaped span of wet concrete 30 confined by forms 32, only one such form being illustrated. As previously mentioned, spreader 20 may be employed in the typical building operation where large rock are being spread on a floor surface, are spread to create exposed aggregrate panels or spread to create large rock surfaces for patio constructions, sidewalks, and the like. Alternatively, for purposes of the present invention, spreader 20 may be used to spread a powder-like, light reflecting and hardening material. Thus, spreader 20 is intended to spread a wide range of particulate material.

Since spreader 20 is expected to be most often used in a building application, there is illustrated in FIG. 1 the typical building columns 40 about which spreader 20 is frequently required to be moved during completion of the material spreading process and is mentioned here to emphasize the need for preserving an overall lightweight construction. Accordingly, bridge 22 is formed of a lightweight, open network of interconnected aluminum frame pieces to facilitate movement around columns 40 as well as to facilitate transport from job site to job site. Side pieces 24 are welded or bolted between lower V-member 26 and later referred to upper rail beams 94, 96 located on either side of top pieces 29 to which rail beams 94, 96 are suitably joined thereby providing a pair of parallel flat surfaced wheel tracks.

A pair of open, inwardly-tapered hoppers 45, 46 are suspended on either side of bridge 22 from a support, carriage-like, structure. The support structure is driven back and forth lengthwise of bridge 22 by means of a gasoline engine driven hydraulic pump and motor system 50 as later described. Spreader 20 of the invention may thus be used, for example, to spread a uniform, wide, single layer of large rock, or other relatively-large, non-uniform or uniform, hard, particulate material over the span of wet concrete or a uniform wide single layer of powder-like, light reflecting and surface hardening particulate material over another span of concrete. Typically, spreader 20 would be used for spreading only one of such materials at any one time. Hoppers 45, 46 are filled with the appropriate large rock, light reflecting-hardening or other material being spread. As hoppers 45, 46 are driven back and forth along bridge 22, spreader 20 is advanced after each pass in one direction so as to provide uniform coverage over the entire surface of the wet concrete span 30 or other surface being covered. In some applications it is desirable to make two or more passes over the same surface to increase the slickness of the layer of material spread. In such cases the bridge is moved only after the hoppers have passed twice over the same surface. Later description relates to a hydraulic valve control system whereby the hoppers are caused to automatically reverse at the end of the first or any subsequent pass.

Figure 2:
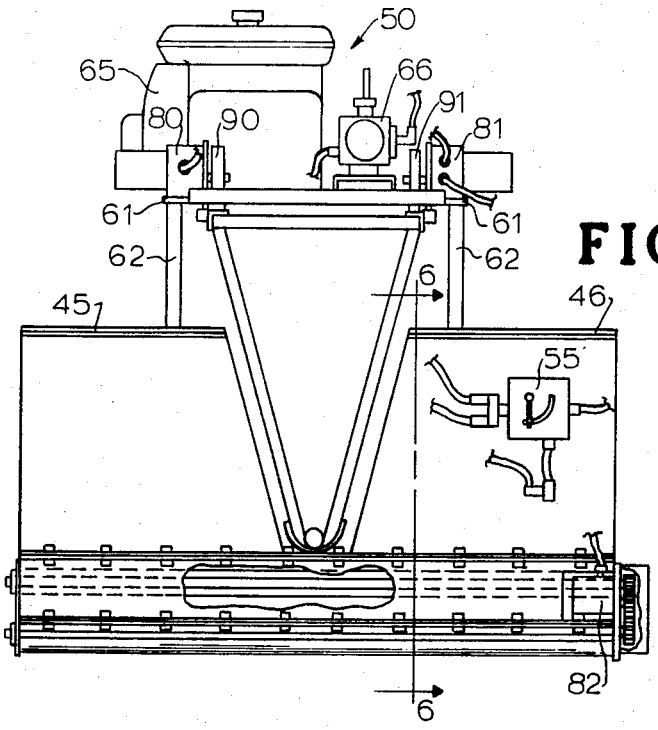
FIG. 2 is a front elevation view of the hopper structure in association with the bridge structure.
Figure 3:
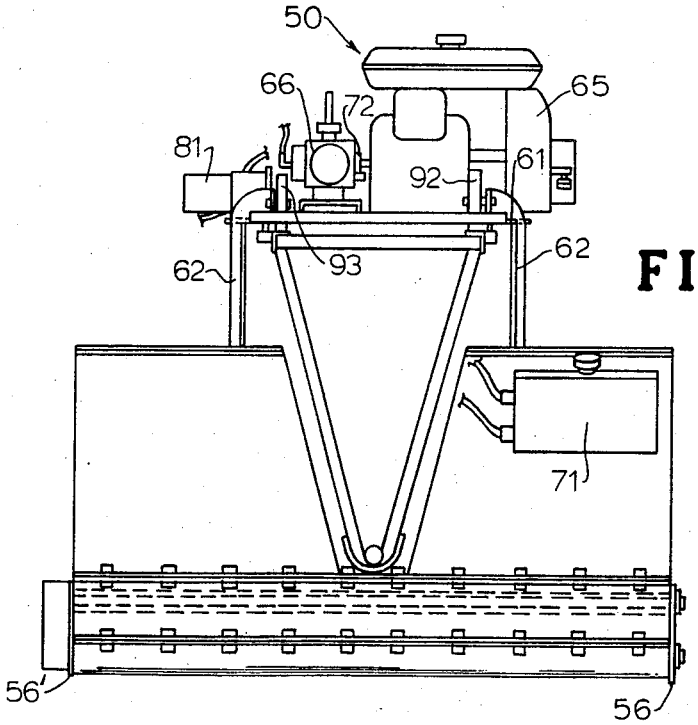
FIG. 3 is a rear elevation view of the FIG. 2 structure.
Figure 4:
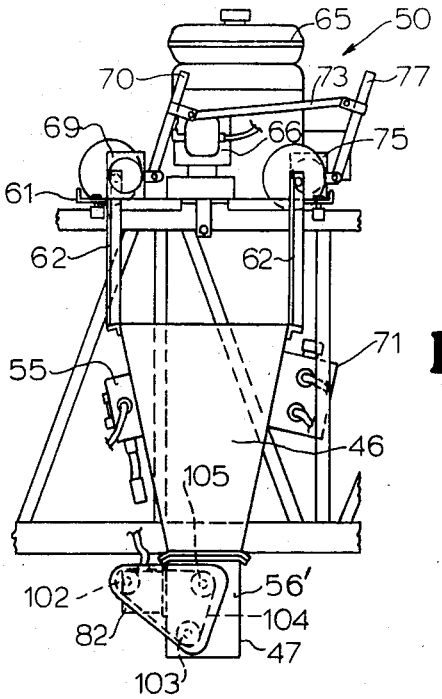
FIG. 4 is a right side fragmentary elevation view.
Figure 5:
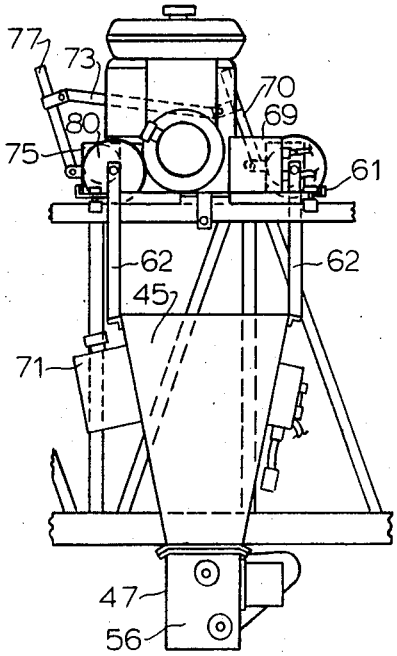
FIG. 5 is a left side fragmentary elevation view.
Figure 6:
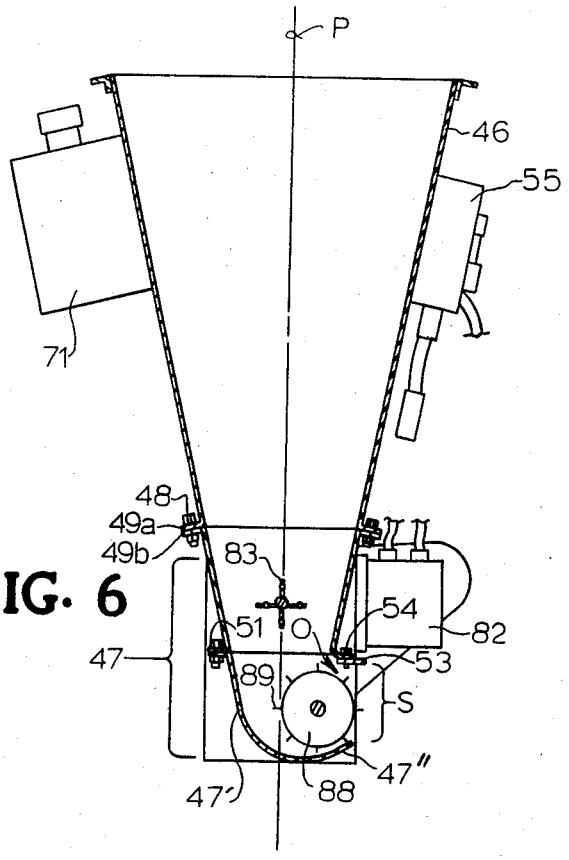
FIG. 6 is a fragmentary section view taken along line 6—6 of FIG. 2.

Referring next to FIGS. 2–4, hoppers 45, 46 are shown suspended by bars 62 secured to base plate 61 on support structure 60. The previously-mentioned engine hydraulic drive assembly 50 mounts on base member 61 and includes a small gasoline engine 65, e.g., 5 horsepower, a hydraulic pump 66, coupling 72, a hydraulic control valve 75 with a control lever 77, a hydraulic control valve 69 with a control lever 70 mechanically linked by link 73 to control lever 77, a hopper-mounted reservoir 71, hydraulic wheel drive motors 80 and 81, and dispensing cylinder drive motor 82. The mentioned components including a manually adjustable cross-over valve 52, check valves 53, 54 and manually adjustable variable flow valve 55 and associated hydraulic lines are interconnected as in FIG. 7.

Figure 7:
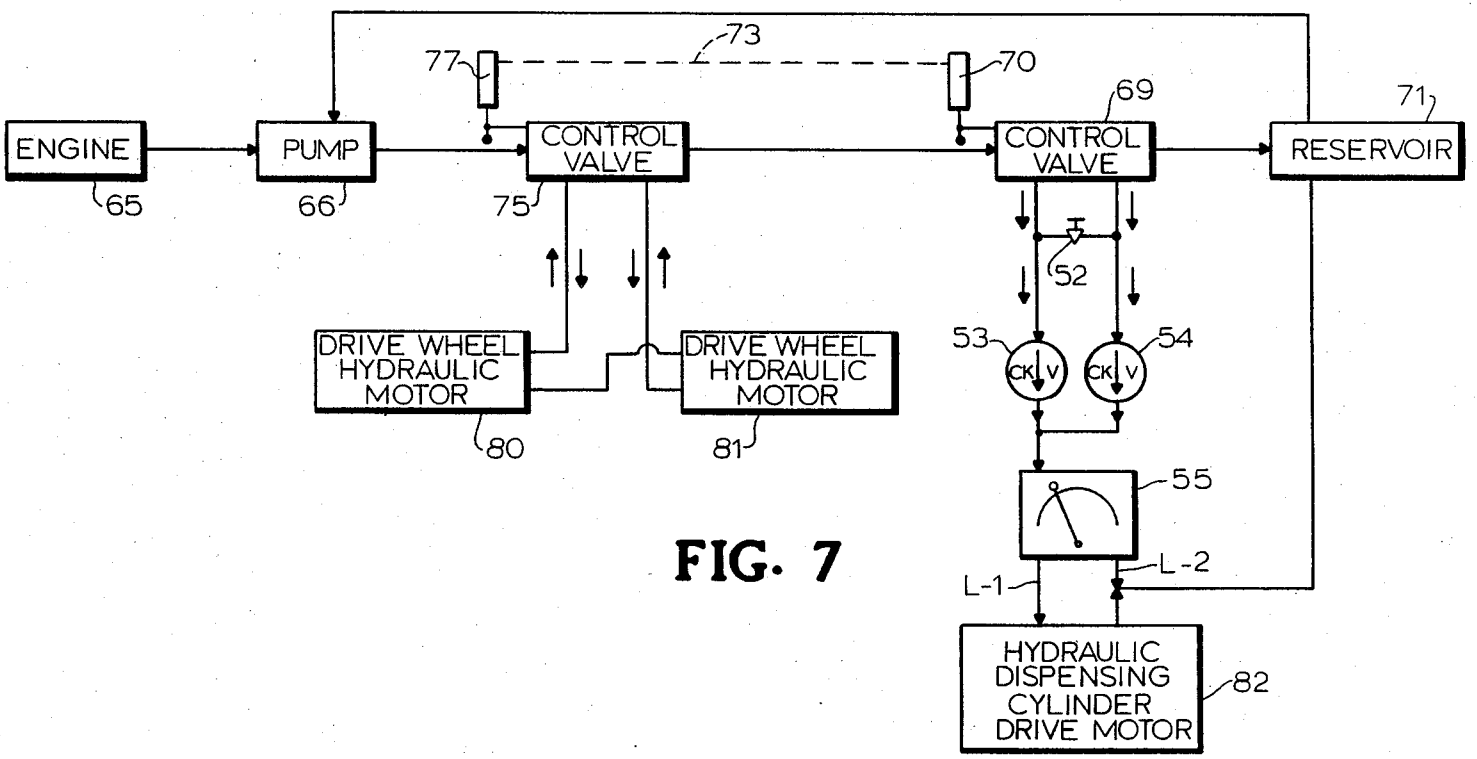
FIG. 7 hydraulic flow diagram for the present invention.

Gasoline engine 65 drives hydraulic pump 66 through coupling 72. Pump 66 through hydraulic control valve 75 and associated control lever 77 and hydraulic control valve 69 and control lever 70 in turn control the operation and direction of rotation of hydraulic drive wheel motors 80, 81, and dispensing cylinder drive motor 82. Hydraulic motors 80, 81 drive wheels 90, 91 which support and power the support structure 60 and cause the hoppers 45, 46 to move back and forth along bridge 22. Wheels 92, 93 provide additional support for support structure 60. Wheels 90–93 are mounted on base plate 61 and extend through openings therein (not shown) to facilitate riding on the flat surfaced rails 94, 96. Hydraulic motor 82 in turn drives the spreader cylinder 88 (see FIGS. 2–6) but always in the same direction independent of the position of control lever 70. That is as best seen in FIG. 7 independent of the position of lever 70, the pressurized fluid is fed through valve 55 to cylinder drive motor 82 only through line L-1 except when valve 55 is adjusted to bypass the pressurized fluid through line L-2. A conventional agitator 83 is driven by chain 104 through gear 105.

Spreader or paddle cylinder 88 comprises a metal cylinder formed with a series of radially spaced lengthwise extending plate formed ribs or vanes 89 to facilitate discharge of the large rock, light reflecting and powder or other material from the hoppers 45, 46. In actual working embodiments of the invention, dispensing cylinder 88 was formed with a plurality of uniformly radially spaced vanes extending for its entire length. The vanes 89 were approximately ⅛ inch thick, ½ inch wide and the radial spacing between the bases of the vanes 89 was generally in the range of ½ inch to 1 inch apart and provided sufficient friction and surface to effectively grab and eject both large rock as well as relatively fine light reflecting powder material. In the event of jamming of either the drive wheels 90, 91, the support structure 60 or the spreader cylinder 88, the hydraulic motors 80, 81 and 82 provide a shock-absorbing clutch-like effect until the fault can be cleared.

Hoppers 45, 46 empty into spreader box 47. Spreader cylinder 88 is located in the lower discharge portion of box 47 below and laterally offset to one side of the discharge slot S and is driven by gear 102 powered by hydraulic motor 82 through gear 103 and chain 104. The lower discharge portion of spreader box 47 is formed by a curved plate member 47' removably secured by bolts 51 or other fasteners providing adjustment of the space between cylinder 88 and curved plate portion 47". As will be best seen in FIG. 6, the vanes 89 of dispensing cylinder 88 effectively sweep the material over curved plate portion 47" to the discharge slot S. Thus, since dispensing cylinder 88 is always driven in the same direction and has its axis of rotation laterally offset from the central vertical plane P cylinder 88 is not forced to lift material during part of its revolution as in the prior art. Also, it has been discovered that a substantially smooth surfaced layer of spread material is produced by this side discharge arrangement. An adjustable plate 53 secured by bolts 54 is positioned for the size material discharged and controls the opening 0 to prevent inadvertent discharge above cylinder 88.

Operation and speed of the hydraulic motor 82 is controlled by a normally closed manual bypass valve 52 and the variable speed manual control valve 55 situated on the sidewall of hopper 45 as diagrammed in FIG. 7 and seen in FIGS. 3 and 4. Cylinder 88 always rotates in the same direction irrespective of the position of lever 77 as previously stated. Spreader cylinder 88 in conjunction with the previously-mentioned vanes 89 facilitates agitation, dispensing and movement of the large rock light reflecting powder or other similar material placed in the respective hoppers 45, 46 for spreading on the wet concrete surface. The speed of rotation of dispensing cylinder 88 in conjunction with the speed of the support structure 60 substantially controls the speed and volume of material spread. Thus, by manually adjusting valve 55, motor 82 can be completely stopped by bypassing all of the fluid, operated at full speed by stopping all fluid bypass or, by opening and proper adjustment of valve 55 can be operated at a less than full speed. It should also be noted that the speed of movement of the support structure 60 back and forth on the bridge 22 can also be controlled by positioning of control valve 75 with lever 77. Thus, the amount of large rock, light reflecting powder or other material spread per unit area can be controlled and varied within wide limits.

Both of the hoppers 45, 46 and spreader box 47 are preferably made of lightweight metal such as plate aluminum. Using hopper 46 as an example, hopper 46 and spreader box 47 are bolted together as indicated at 48 to provide an overall complete hopper with the tops open and located below rails 94, 96 as illustrated in FIG. 1 for receiving the large rock, light reflecting powder or other material to be spread. Looking more closely at FIGS. 2–6, spreader box 47 mounts to hoppers 45, 46 by means of appropriate flanges **49*a*, 49*b* held securely together by previously-mentioned bolts 48. Spreader box 47 mounts a pair of end plates 55, 56' which in turn mount spreader cylinder 88. Cylinder 88 is provided with stub shafts 88*a*, 88*b*, not shown, extending outwardly from the ends of cylinder 88. Stub shaft 88*a* rotatably mounts in a bearing on end plate 56 and extends outwardly therefrom. Likewise, stub shaft 88*b* rotatably mounts in a bearing on end plate 56'. The outer end of stub shaft 88*a* mounts gear 102. Hydraulic motor 82, previously referred to, is adjustably mounted on the side of spreader box 47 adjacent end plate 56. Motor 82 drives gear 103 which in turn drives 102 through drive chain 104**.

Hydraulic control valve 75 through manipulation of lever 77, provides means for controlling the direction of flow to hydraulic motors 80, 81 and thus controls the direction in which the wheels 90, 91 move the hoppers 45, 46 and dispenser box 47 back and forth on the rails 94, 96. A hydraulic control of this type is well known and its use in the invention system will be understood by those skilled in the art. In operation, engine 65 is started with control levers 70 and 77 in neutral positions allowing the hydraulic fluid to circulate from pump 66 through control valves 75 and 69 to reservoir 71 and then back to the pump 66 without flowing through hydraulic motors 80, 81 or 82. In normal operation, hoppers 45, 46 are filled with large rock, light reflecting powder, or other material to be spread and after each pass, one of the operators standing outside the concrete surface and near the end of the pass manipulates control lever 77 so as to reverse the direction in which hydraulic motors 80, 81 are turning so as to thereby reverse the direction wheels 90, 91 move hoppers 45, 46 back and forth on bridge 22. Bypass valve 55 is also adjusted as required for the size of the rock being spread to control the speed of motor 82.

As an improvement over having to manually reverse the carriage after each pass, the invention provides opposed bridge frame mounted lever operator bars 125, 126. Lever bar 125 is located so as to strike and reverse valve control lever 77 and lever bar 126 is located so as to strike and reverse valve control lever 70. Thus, when it is desirable to avoid manual reversing from either end of the bridge, the operator can station himself at the opposite end.

Figure 8:
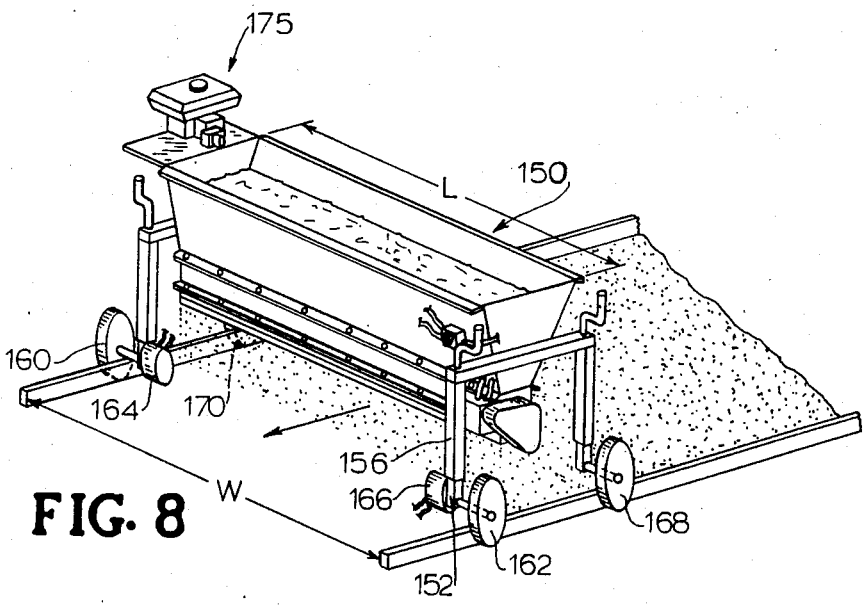
FIG. 8 is a pictorial view of the invention apparatus according to a second embodiment.

Making reference next to FIG. 8, there is shown a single hopper 150 equipped with the previously-described side discharge dispensing apparatus of the invention. In this second embodiment of the invention, hopper 150 is supported on four extendible legs 152 controlled by operator levers 154 and appropriate screw mechanism enclosed in the leg housings 156. Since screw mechanisms for retracting and extending legs are well known, further details of such mechanisms are not deemed necessary.

A pair of front wheels 160, 162 are driven by hydraulic motors 164, 166 in the manner previously explained and support hopper 150 in conjunction with a pair of non-driven wheels 168, 170. In FIG. 8, the hopper is shown being guided by a pair of parallel rails or forms 172, 174 as for example might constitute the boundaries of a new road over which rock is being spread. In such example, the length L of hopper 150 would generally conform to the width W of the road being surfaced. The illustrated engine 175 mounted on plate 176 in FIG. 8 corresponds to the engine 50 of the first embodiment and forms part of an overall system similar to that previously explained in conjunction with FIG. 7. Thus, all of the components of the system of the second embodiment are not shown in further detail because of the prior description.

In summary, the following advantages are obtained:

(a) Required power for the dispensing cylinder is substantially reduced.

(b) The direction of rotation of dispensing cylinder is not required to be reversed on each pass.

(c) Wear on the dispensing cylinder vanes is reduced by reason of not having to lift the material during part of each rotation.

(d) Discharge of the material is always made through the same discharge slot independent of the direction of the pass.

(e) The so-called "washboard effect" is minimized and the spread material assumes a substantially smoother surface than previously obtained.

(f) A wide range of material varying from relatively large rock to powder-like materials can be spread with the same apparatus.

(g) The improved side discharge material dispensing apparatus lends itself to dispensing from a pair of hoppers by consecutive back and forth passes across the rock as in FIG. 1 or by utilizing a single hopper and dispensing always in the same direction lengthwise of the work as in road construction and as depicted in FIG. 8.

(h) When desired, the dispensing apparatus can be automatically reversed when spreading in back and forth passes.

(i) The dispenser box is readily removable for repair or substitution of other types of dispensers on the same hopper.

(j) The advantage of dissipating the hydraulic fluid heat by use of a hopper-mounted reservoir as in my prior U.S. Pat. No. 4,555,200 is retained.

What is claimed is:

1. A material spreader for spreading a layer of particulate material of substantially uniform width and thickness over a defined surface, said spreader comprising:

(a) a hopper assembly including:

(i) an open top hopper structure for receiving and storing material to be spread;

(ii) an upper material dispenser box formed by side and end walls defining an open top communicating with said hopper structure and an open bottom with the length of said box being substantially equal to the width of the layer of material to be spread; and (iii) a lower material dispensing section secured to and supported below said dispenser box, said lower section being formed by end walls and between said end walls an upwardly curved bottom wall defining an open top of said lower section mating the open bottom of said dispenser box, one side of said bottom wall forming a continuation of one sidewall of said dispenser box and the other side of said bottom wall terminating with an edge extending for the length of said dispenser box and located below and parallel to the bottom edge of the other said sidewall of said dispenser box thereby forming a side discharge dispensing slot located below and laterally offset from the central vertical plane of said dispenser box;

(b) support structure mounting said hopper assembly for movement above and in the direction of the uncovered surface over which a layer of material is to be spread;

(c) a gasoline engine mounted on said support structure and having a drive shaft powered by said engine;

(d) a hydraulic pump mounted on said support structure and coupled to said drive shaft;

(e) a plurality of hydraulic motors fluidly connected for being driven by pressurized fluid produced by said pump;

(f) a reservoir supported by said support structure for storing hydraulic fluid utilized by said pump and motors;

(g) drive means on said support structure for driving said support structure and thereby moving said hopper assembly over the surface to be covered by said material, said drive means including one or more of said hydraulic motors to drive one or more wheels supporting said support structure;

(h) a paddle member extending for the length of and mounted in said lower dispensing section for ejecting material therefrom through said slot, said paddle member having a drive connection to another of said motors for driving said paddle member to assist the flow of material through said slot during operation of said spreader, said paddle member rotating about an axis laterally offset from the central vertical plane of said dispenser box, said paddle member being mounted for rotation in a circular path adapted to collect material falling by gravity onto said bottom wall and sweeping such material upwardly on said bottom wall to said discharge slot to thereby be discharged; and (i) control valve and conduit means on said support structure including an operator-control member and conduit interconnecting said pump, motors, reservoir and valve means positioned by said control member to allow selective stopping and reversing of the direction of the motors driving the wheels on said support structure while allowing said paddle member when operating to continuously rotate in the same direction independent of the direction of movement of said support structure and hopper assembly.

2. A material spreader as claimed in claim 1 including auxiliary valve means enabling the flow of hydraulic fluid to said motor driving said paddle member to completly bypass said paddle member drive motor to stop said paddle member rotation independent of the driving of said support structure drive wheels or in the alternative operate at full speed or less than full speed.

3. A material spreader as claimed in claim 1 including means for adjusting the clearance between the upper part of said paddle member and the upper edge of said dispenser slot whereby to adapt said material spreader to dispensing both relatively rock-like as well as relatively powdery materials.

4. A material spreader as claimed in claim 1 wherein said control valve and conduit means include a first control valve and conduit means operative to control selective stopping and reversing of the direction of said drive motors driving said support structure drive wheels and a second control valve, conduit and valve means enabling said paddle member to be selectively stopped, operated at full speed or less than full speed and continuously in the same direction.

5. A material spreader as claimed in claim 4 including means mechanically linking said first and second control valves.

6. A material spreader as claimed in claim 1 including an agitator member mounted above said paddle member and extending for the length of and mounted in the lower area of said dispenser box for agitating material passing through the open bottom of said dispenser box prior to reaching said paddle member, said agitator member having a drive connection to said paddle member and being operative for rotating in the same direction as said paddle member.

7. A material spreader as claimed in claim 1 wherein said support structure comprises:

(a) first and second spaced apart wheeled frames mounted on opposite ends of said hopper assembly; and (b) said drive means includes a pair of said hydraulic motors mounted to drive a corresponding pair of wheels on said wheeled frames.

8. A material spreader as claimed in claim 1 wherein said support structure comprises:

(a) a bridge structure supported above and spanning the width of the concrete or other surface over which the material is being spread and having supporting means adapting said bridge structure to be moved along the length of said surface, said bridge structure providing wheel tracking surfaces on opposite top side surfaces thereof;

(b) a carriage structure supported by wheels on said bridge structure and movable back and forth along an elevated path on said wheel tracking surfaces provided by said bridge structure; and (c) said hopper assembly, gasoline engine pump, reservoir and control valve and conduit means are all supported by said carriage structure and said carriage structure is driven back and forth on said bridge structure by selected said motors.

9. A material spreader for spreading a layer of particulate material of substantially uniform width and thickness over a wet concrete or other defined surface, said spreader comprising:

(a) a bridge structure supported above and spanning the width of the concrete or other surface over which the material is being spread and having supporting means adapting said bridge structure to be moved along the length of said surface, said bridge structure providing wheel tracking surfaces on opposite top side surfaces thereof;

(b) a carriage structure supported by wheels on said bridge structure and movable back and forth along an elevated path on said wheel tracking surfaces provided by said bridge structure;

(c) hopper means comprising a pair of hoppers mounted on opposite sides of said bridge structure and a dispenser box having a top portion integral with the bottoms of said hoppers and a bottom portion having a curved bottom wall and above and laterally offset from said curved bottom wall a lengthwise extending horizontal side discharge dispensing slot, said hoppers being supported from and having open tops located below said carriage structure, for storing material to be spread and dispensing such material through said slot as said hopper means and support structure move back and forth on said bridge structure;

(d) a gasoline engine mounted on said carraige structure and having a drive shaft powered by said engine;

(e) a hydraulic pump mounted on said carriage structure and coupled to said drive shaft;

(f) a plurality of hydraulic motors fluidly connected for being driven by pressurized fluid produced by said pump, selected of said hydraulic motors being mounted on said carriage structure and at least one being mounted on said hopper means;

(g) a reservoir for storing hydraulic fluid utilized by said pump and motor mounted on said hopper means;

(h) drive means on said carriage structure for driving said carriage structure on said bridge structure, said drive means including one or more of said hydraulic motors connected to drive one or more of said wheels;

(i) a dispensing cylinder extending for the length of and mounted within said curved bottom wall and laterally offset from said slot, said dispensing cylinder having a drive connection to another of said motors located on said hopper means for driving said dispensing cylinder to assist the flow of material through said slot during operation of said spreader, said dispensing cylinder being formed of metal and having peripherally spaced apart vanes on the surface thereof providing an overall paddle formation thereon; and (j) control valve and conduit means including an operator-control member and conduit interconnecting said pump, motors, reservoir and valve means positioned by said control member to allow selective speed control, stopping, and reversing of the direction of selected said motors dependent on the position of said control member whereby irrespective of the direction said carriage structure is driven on said bridge structure, said dispensing cylinder is driven in the same direction with said vanes on said dispensing cylinder being effective to dispense said material through said slot.

10. A material spreader as claimed in claim 9 including valve positioning means fixed on opposite ends of said bridge structure and operative when contacted by a said operator control member to reverse the direction of said carriage structure drive motors.

* * * * *